US007208016B2

(12) United States Patent
Kleban et al.

(10) Patent No.: US 7,208,016 B2
(45) Date of Patent: Apr. 24, 2007

(54) CHROMIUM-FREE, WATERPROOF LEATHER

(75) Inventors: Martin Kleban, Leverkusen (DE); Ahmet Kaplan, Leverkusen (DE); Jürgen Reiners, Leverkusen (DE); Henrik Winther, Bergisch Gladbach (DE)

(73) Assignee: Lanxess Deutschland GmbH, Leverkusen (DE)

( * ) Notice: Subject to any disclaimer, the term of this patent is extended or adjusted under 35 U.S.C. 154(b) by 0 days.

(21) Appl. No.: 11/368,054

(22) Filed: Mar. 3, 2006

(65) Prior Publication Data

US 2006/0151738 A1 Jul. 13, 2006

Related U.S. Application Data

(62) Division of application No. 10/694,106, filed on Oct. 27, 2003, now Pat. No. 7,060,363.

(30) Foreign Application Priority Data

Oct. 28, 2002 (DE) ..... 102 50 111

(51) Int. Cl.
*C14C 9/00* (2006.01)
*C14C 9/02* (2006.01)
*C14C 3/00* (2006.01)

(52) U.S. Cl. ..... 8/94.2; 8/94.1 R; 8/94.19 R; 8/94.26; 8/94.28; 252/8.57; 427/389

(58) Field of Classification Search ..... 252/8.57; 8/94.1 R, 94.19 R, 94.2, 94.26, 94.28; 427/389
See application file for complete search history.

(56) References Cited

U.S. PATENT DOCUMENTS 3,402,071 A 9/1968 Heyden et al. ..... 117/141
4,701,269 A * 10/1987 Bay et al. ..... 252/8.57
4,762,522 A * 8/1988 Maue ..... 8/94.19 R
4,931,062 A * 6/1990 Bay et al. ..... 8/94.23
5,117,509 A * 6/1992 Bowers ..... 2/161.1
5,702,490 A * 12/1997 Kneip et al. ..... 8/94.23
5,980,578 A * 11/1999 Kaussen et al. ..... 8/94.21
6,379,751 B1 4/2002 Schafer et al. ..... 427/389
7,060,363 B2 * 6/2006 Kleban et al. ..... 428/540
2004/0232376 A1 * 11/2004 Kleban et al. ..... 252/8.57

FOREIGN PATENT DOCUMENTS

DE 2709507 A1 * 9/1977
DE 196 29 988 A 1/1998
EP 526815 A1 * 2/1993
EP 757108 A2 * 2/1997
EP 1416058 A1 * 5/2004

OTHER PUBLICATIONS

Derwent Abstract No. 1988-206172, abstract of German Patent Specification No. DD254595A (Mar. 1988).*

Derwent Abstract No. 1988-206173, abstract of German Patent Specification No. DD254596A (Mar. 1988).*

Tonigold L et al: "Moglichkeiten und Grenzen Der Eisengerbung" Leder, Eduard Roether Verlag. Darmstadt, DE Bd. 41, Nr. 1, 1990, Seiten 8-14, XP000113346; ISSN: 0024-0176; *das ganze Dokument *, (no month).

* cited by examiner

*Primary Examiner*—Anthony J. Green
(74) *Attorney, Agent, or Firm*—Michael A. Miller

(57) ABSTRACT

Chromium-free leather having a waterproofness, measured as penetration time according to DIN 53338 , of at least 30 min.

3 Claims, No Drawings

CHROMIUM-FREE, WATERPROOF LEATHER

This application is a Divisional of Ser. No. 10/694,106 filed Oct. 27, 2003 now U.S. Pat. No. 7,060,363.

FIELD OF THE INVENTION

The invention relates to chromium-free leather having high waterproofness, using silicones as water repellents, and a process for preparing and using the same, as well as the process for using silicones as water repellants for the chromium-free leather.

BACKGROUND OF THE INVENTION

There is a considerable market demand for waterproof leather for shoes, clothing or bags. However, the leathers are per se hydrophilic and most tanning agents and retanning agents as well as fatliquoring agents used in treating them are used by means of dispersants.

Most leathers used to date are chrome-tanned, owing to the particularly outstanding properties of this process. Only a few special leathers, such as sole leather, belt leather or leather for automotive dashboards, have been tanned with vegetable and/or with syntan tanning agents instead of with chromium.

However, the disadvantage of chrome-tanned leathers is considerable. Thus, for example, leather wastes which occur during the production of leather articles and leather at the end of the useful life present problems with regard to waste disposal, especially since chromium is no longer permitted to be stored on certain landfills. Moreover, chrome-tanned leather may develop traces of Cr(VI) under certain storage conditions or during incineration.

Other tanning systems which are on the market, such as, for example, aluminium, glutaraldehyde or tetrahydroxymethylphosphonium salt, have, apart from ecological problems, the disadvantage of compensating for chrome tanning salts with larger amounts of other generally hydrophilic tanning agents, such as vegetable extracts and synthetic, aromatic syntans, with resulting adverse effects on the waterproofness of the leather. Such substances undesirably increase the hydrophilicity of the leather, in a manner that makes the leather harder. In order to counteract this tendency, larger amounts of fatliquoring agents have to be used, which in turn have to be applied by means of emulsifiers, which may adversely affect waterproofness.

In the customary production process for waterproof leathers, chrome-tanned leather is treated with a combination of fatliquoring agents and water repellency enhancers, which are typically silicone emulsions. If this treatment is effected in water, use of emulsifiers for the water repellency enhancers is necessary, but adversely affects the waterproofness. In order to avoid the disadvantages of the hydrophilicity induced by emulsifiers in conventional, chrome-tanned systems, emulsification is carried out by means of compounds whose emulsifying, functional groups can be destroyed in a subsequent fixing step, usually with chromium salts.

The customary waterproofing compositions are non-sulphonated fatliquoring agents and water repellency enhancers which are fixed by means of mineral salts—as a rule with chromium(III). Such systems lead to open water repellency on chrome-tanned leathers, i.e., the generation of a hydrophobic network around the fibres without filling the spaces thereof.

However, when the customary waterproofing compositions are used on chromium-free leather, the desired waterproofness cannot be achieved because the amount of the chrome tanning agent has to be replaced by large amounts of hydrophilic vegetable tanning agents and/or syntans. The hydrophilic ingredients in the leather promote the penetration of water into the leather and not the opposite effect for water repellency.

The prior art is illustrated, for example, by H. Birkhofer, Reactive Hydrophobiermittel [Reactive Water Repellents], Das Leder [Leather] 1992, 71–75; Danisch, P. et al. Modern Hydrophobic Systems, JALCA, 1996, 120–125 Reiners, J. et al. Waterproofing of Leather, ALCA-Congress, Skytop, Pa., 2002 (to be published JALCA 2002).

It is therefore an object of the invention to provide waterproof leathers tanned without chromium.

SUMMARY OF THE INVENTION

The invention relates to chromium-free leather having waterproofness, measured as the penetration time according to DIN 53338, of at least 30 min., preferably of more than 2 hours.

"Chromium-free" in the context of the present invention means the leather is not tanned as is typically done with chromium salts. It is however notable that chromium, e.g. provided by natural sources of Cr in animal hides or chromium-containing dyes in the leather, can be present in an amount that is less than about 2 000 ppm. For leathers not dyed with chrome-containing dye, the maximum amount of chromium in the leather is preferably less than 100 ppm.

The chrome-free leather according to the invention preferably has a shrinkage temperature of greater than 70° C., in particular greater than 75° C.

The chrome-free leather according to the invention can have an iron content which is preferably from about 1 to 7% by weight more preferably from about 1 to 6% by weight. The iron content is determined as follows: A sample of the leather is dried at 70° C. in vacuo to constant weight to obtain the reference weight. Ashing is then effected at 800° C. and the content of Fe(III) is determined by a commercial wet chemical method and is related to the reference weight. The iron content preferably results from the tanning with iron salts.

The iron tanning is known in principle, cf. for example prior art: Stather, Gerbereichemie und Gerbereitechnologie [Tanning chemistry and tanning technology], Akademie Verlag, Berlin, 1957, 474–480; Heidemann E. at al., Möglichkeiten und Grenzen der Eisengerbung [Possibilities and limitations of iron tanning], Das Leder [Leather], 1990, 8–14; Balasubramanian S. et al., Iron Complexes as Tanning Agents, JALCA, 12997, 218–224.

In a further preferred embodiment, the leather according to the invention has an Si content of at least 0.2% by weight, and, in particular at least 1.0% by weight, determined as silicate after incineration.

The leather according to the invention preferably contains silicones as water repellents, in particular those which were used as water repellents in the description of the production process below.

DETAILED DESCRIPTION OF THE INVENTION

In an embodiment which is preferred herein, the leather according to the invention has a water vapour permeability, measured according to DIN 53333, of greater than 0.8 mg/cm$^2$ h, and in particular greater than 2 mg/cm$^2$ h.

Leather having a low water or water vapour content is very comfortable to wear. The leather according to the invention is therefore preferably characterized by a water absorption of less than 30% by weight, in particular less than 20% by weight to a water penetration in the measurement according to DIN 53338 or after contact with water for 8 hours. The invention furthermore relates to a process for the production of the leather according to the invention, which is characterized in that leather tanned without chromium is treated by means of a water repellent.

It is preferable to use a water repellent which a) is self-emulsifying in water and has ionic pH-sensitive groups, and/or b) is used in combination with an emulsifier, the emulsifier having ionic pH-sensitive groups.

The term pH-sensitive is to be understood as meaning functional groups which, at a pH of 4.1–8 typical for retanning, have an emulsifying effect which is sufficient to form a stable aqueous emulsion with hydrophobic active substance, and loses its emulsifying effect as a result of a change in the pH, preferably with a reduction to 2.5–4.0, in particular 3.3–3.9.

In the context of this application, preferred ionic, pH-sensitive groups are to be understood as meaning, for example, carboxylic acids and/or their salts or amines and/or their salts, substituted sulphonylureas or cyanoureas and/or their salts. This means reaction products of toluenesulphonyl isocyanate and amines or cyanamide and isocyanates, and their salts which form on addition of bases (triethylamine, NaOH).

Fatliquoring agents which are free of electrolyte-stable anionic emulsifiers, e.g. sulphonated, sulphated or sulphited compounds having an emulsifying effect are to be considered herein as fatliquoring agents suitable for imparting water repellency. For example, fats and oils based on long-chain alkanes, alcohols, esters or other hydrophobic hydrocarbons are suitable here. These compounds may be of natural or synthetic origin, such as, for example, fish oils, neatsfoot oils, vegetable oils or mineral oils.

In a preferred embodiment, emulsifiers based on carboxylic acids, polycarboxylic acids or polyethers may be added to these fatliquoring agents in order to facilitate processing in aqueous liquor.

Modified silicones, in particular polysiloxanes, may be mentioned as preferred water repellents having ionic, pH-sensitive groups.

Suitable polysiloxanes are, for example, linear, branched or cyclic polysiloxanes which are optionally substituted. Polydimethylpolysiloxanes which are optionally substituted are preferred. Suitable substituents are either linked to the polysiloxane main chain via a spacer which optionally may be interrupted by hetero atoms or functional groups, or may also be bonded directly to a silicon atom of the polysiloxane main chain.

Polysiloxanes characterized in that the polysiloxane chain contains at least one structural unit of the formula (1)

$$[AR_aSiO_{(3-a)/2}]_k \quad (1)$$

and/or at least one structural unit of the formula (2)

$$[R_cSiO_{(4-c)/2}]_n \quad (2)$$

and optionally one or more terminal groups selected form the formulae $$R_3SiO_{1/2} \quad (3)$$

and $$AR_2SiO_{1/2} \quad (3a)$$

in which

R represents a $C_1$ to $C_{12}$-alkyl radical, a $C_1$ to $C_{12}$-alkoxy radical, a hydroxyl radical or a phenyl radical, a represents 0 or 1, k represents 0 to 50, c represents 1 or 2 and n represents 10 to 1 000, A represents hydrogen, an alkyl, alkoxy, hydroxyl, perfluoroalkyl or phenyl radical, or a radical of the formula $R^7$—G—, in which $R^7$ represents hydrogen, a hydroxy, carboxyl, epoxy or aldehyde group, ($C_1$–$C_4$)-alkyl or ($C_1$–$C_4$)-alkoxy and G represents a divalent, optionally branched, $C_2$- to $C_{60}$-hydrocarbon radical which may be interrupted by non-adjacent ether, ester, amido, carbonate or urethane groups and which is optionally substituted by hydroxyl groups or alkyl or aryl radicals, or A represents a radical of the formula

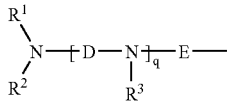

in which $R^1$, $R^2$ and $R^3$, independently of one another, represent hydrogen or represent a monovalent $C_2$–$C_{60}$-hydrocarbon radical which optionally contains one or more non-adjacent ether, imino, amido, urea, urethane, ester or carboxyl groups and which is optionally substituted by one or 2 carboxyl groups —COOM and/or 1 or 2 hydroxyl groups, in which M represents hydrogen or

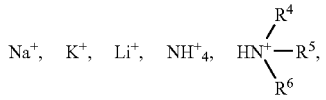

in which $R^4$, $R^5$ and $R^6$, independently of one another, represent $C_1$–$C_{18}$-alkyl, in particular $C_1$–$C_4$-alkyl or substituted $C_1$–$C_{18}$-alkyl, in particular hydroxyalkyl, or aralkyl, in particular benzyl, and in which $R^1$ to $R^3$, independently of one another, are linked to the nitrogen atom via a single bond or a —COO—, —CO— or —CONH— group, and in which $R^1$ and $R^2$ are not simultaneously linked to the nitrogen atom via a carbonyl group, D and E, independently of one another, represent a divalent $C_2$–$C_{20}$-hydrocarbon radical which may be substituted by hydroxyl or may be interrupted by non-adjacent O atoms, and q represents 0 to 3, are particularly preferred, with the proviso that at least one terminal group of the formula (3a) is present when the polysiloxane chain contains only structural units of the formula (2). Polysiloxanes containing carboxyl groups, characterized in that the polysiloxane chain contains at least one structural unit of the formula (I)

$$[AR_aSiO_{(3-a)/2}]_k \quad (1)$$

and/or at least one structural unit of the formula (2)

$$[R_cSiO_{(4-c)/2}]_n \quad (2)$$

and optionally one or more terminal groups selected from the formulae $$R_3SiO_{1/2} \quad (3)$$

and $$AR_2SiO_{1/2} \quad (3a)$$

in which

A represents a radical containing carboxyl groups

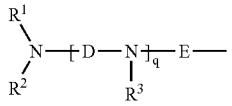

in which $R^1$, $R^2$ and $R^3$, independently of one another, represent hydrogen or represent a monovalent $C_2$–$C_{60}$-hydrocarbon radical which optionally contains one or more non-neighbouring ether, imino, amido, urea, urethane, ester or carboxyl groups and which is optionally substituted by one or 2 carboxyl groups —COOM and/or 1 or 2 hydroxyl groups, and in which the radical A is substituted at least by one group COOM, in which M represents hydrogen or

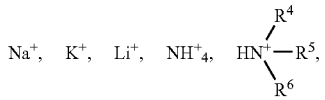

in which $R^4$, $R^5$ and $R^6$, independently of one another, represent $C_1$–$C_{18}$-alkyl, in particular $C_1$–$C_4$-alkyl, or substituted $C_1$–$C_{18}$-alkyl, in particular hydroxyalkyl, or aralkyl, in particular benzyl, and in which $R^1$ to $R^3$, independently of one another, are linked to the nitrogen atom via a single bond or a —COO—, —CO— or —CONH— group, and in which $R^1$ and $R^2$ do not simultaneously represent H and also are not simultaneously linked to the nitrogen atom via a carbonyl group, D and E, independently of one another, represent a divalent $C_2$–$C_{20}$-hydrocarbon radical which may be substituted by hydroxyl or may be interrupted by non-neighbouring O atoms, q represents 0 to 3, R represents a $C_1$ to $C_{12}$-alkyl radical, a $C_1$ to $C_{12}$-alkoxy radical, a hydroxyl radical or a phenyl radical, a represents 0 or 1, k represents 0 to 50, c represents 1 or 2 and n represents 10 to 1 000, are particularly preferred, with the proviso that at least one terminal group of the formula (3a) is present when the polysiloxane chain contains only structural units of the formula (2).

Suitable polysiloxanes are preferably polydialkylpolysiloxanes, polyalkylarylpolysiloxanes, or polysiloxanes which are substituted by hydroxyalkyl, aminoalkyl, carboxyalkyl, hydroxyaryl or carboxyaryl groups and which are linked to the polysiloxane main chain via a spacer, it being possible for the spacer itself to be an alkylene radical or a hydrocarbon radical interrupted by functional groups, e.g. ester, amido, urethane, carbonate, urea, ether or imino.

The polysiloxanes containing carboxyl groups and mentioned in EP-A 11 08 765 and the polysiloxane raw materials used for their preparation are particularly preferred. Other preferred polysiloxanes are those which have hydrolyzable radicals (Si—OR groups), which lead to crosslinking of the polysiloxanes on drying.

Polysiloxanes which are present as an aqueous dispersion and can therefore be used in aqueous liquor are particularly preferred.

The water repellent is preferably used in an amount of 0.1 to 10% by weight, based on shaved weight of the leather, but in particular 1 to 5% by weight. When water repellents without ionic, pH-sensitive groups are used, the amount is preferably 0.1 to 9% by weight. In the latter case, emulsifier having ionic, pH-sensitive groups is also preferably used in an amount of 5 to 25% by weight, based on water repellent.

The self-emulsifying water repellent having ionic, pH-sensitive groups is preferably used in an amount 0.1 to 10% by weight, but in particular 1 to 5% by weight, based on shaved weight of the leather.

The chromium-free leather, which is optionally subjected to retanning with the water repellent, has preferably been tanned using iron compounds. In the context of this invention, "retanning" is understood as meaning the aftertreatment of leather tanned without chromium, in order to optimize colour, levelness, softness and body, but in particular the behaviour towards water (water repellency), and to fix tanning agents and auxiliaries.

In general, pelts, preferably pickled pelts, used for this purpose, are treated with an iron salt. The iron salt may be added to the pelts either as a salt or as an aqueous solution. Preferred iron salts are those of iron in the oxidation stage +3, for example iron chloride, iron sulphate or basic iron sulphate, and those of iron in the oxidation stage +2, such as iron sulphate. The amount of iron is preferably 0.3 to 5% by weight, in particular 1 to 3% by weight, based on the pelts used. The tanning is preferably effected in water at a temperature of 0–60° C., preferably 20–37° C.

After addition of the iron salts for the tanning, the tanning liquor should have a pH of 1.0 to 3.2, preferably of 1.4 to 2.5. After an appropriate penetration time which is typically from 30 min. to 24 h, preferably 1 h to 12 h, the pH of the tanning liquor is increased for fixing the iron salts. A basic compound, e.g. sodium hydroxide, carbonate, bicarbonate or formate, calcium carbonate or magnesium oxide, is preferably used for this purpose. The pH range of 3.0 to 6.0, preferably 3.1 to 4.0, should be achieved.

The iron-tanned leather thus obtained has a shrinkage temperature of greater than 70° C., preferably greater than 75° C. Moreover, it has a uniform yellow colour. It can, for example, be mechanically aftertreated, for example by samming, shaving, etc. on conventional tannery machines.

The leather tanned in this manner and optionally mechanically aftertreated can then be retanned in an optional step.

During the retanning, the pH is in general in the range from 4.1 to 8.0 and is thus suitable for the penetration of the products of the retanning into the leather. In order to fix optionally used retanning agents as well as the water repellents provided with pH-sensitive groups, or emulsifiers, the pH is preferably reduced to 2.5 to 4.0, in particular to 3.3 to 3.9, after the imparting of water repellency. Organic acids, such as formic acid, acetic acid or oxalic acid, optionally in combination with inorganic acids, such as sulphuric acid or phosphoric acid, are preferably used for this purpose.

For the retanning process, the water content of the iron-tanned leather is preferably reduced by samming, and the thickness of the leather is then corrected by shaving if necessary.

The retanning process preferably takes place in aqueous liquor at a temperature of 0 to 70° C., and in particular of 20 to 50° C., in a tanning vessel, and optionally comprises further auxiliaries, such as, for example, polymers, synthetic retanning agents, vegetable tanning agents, colorants, acids and bases, in addition to the water repellents and fatliquoring agents according to the invention.

The synthetic retanning agents used for this application are, for example, water-soluble condensates of sulphonated aromatics, formaldehyde and optionally further substances from the groups consisting of aromatics, urea or urea derivatives.

Vegetable tanning agents useful herein are tanning agents obtained from vegetable sources, said tanning agents being from the classes consisting of the condensed tanning agents or hydrolyzed tanning agents, e.g. chestnut extract, mimosa, tara or quebracho.

The dyes useful herein are water-soluble dyes customary in leather applications, for example dyes from the groups consisting of the acid dyes, direct dyes, metal complex dyes or substantive dyes.

The polymers preferred for the application are high molecular weight water-soluble or water-dispersible products, for example those derived from the (co)polymerization reaction of unsaturated acids and the derivatives thereof having, for example, a filling or fatliquoring effect on the leather.

Acids and bases serve as agents for changing the pH of the aqueous liquor in order to influence the penetration properties of the compounds used or to fix them.

The water repellents and fatliquoring agents according to the invention are used in general in the proportion of 20 to 1 000, preferably from 50 to 200, % aqueous liquor, based on the weight of the leather used, in a pH range of 4.1 to 8.0, preferably 5.0 to 7.5. They can be added in amounts of 0.1 to 10% by weight, preferably 1–5% by weight, of the water repellent and 1–20%, preferably 2–12%, of the fatliquoring agent, in one or more steps. Further auxiliaries used can likewise be added in one or more steps, together with or separately from the products according to the invention.

The retanning process is carried out in 1–48 h, preferably in 1.5–24 h, and in particular in 2–8 h.

The sequence of a retanning process is further illustrated by the examples hereinbelow but is in no way limited to these.

The wet leathers obtained from the retanning can be dried and finished by means of the customary technical methods and machines, i.e. for example by vacuum drying, drying on a toggle frame or hanging out to dry and optionally subsequent staking, milling, buffing or polishing.

The leathers obtained can be finished with a polymeric film by means of commercial products and machines for improving the surface properties and physical fastnesses, as described, for example, by W. Wenzel in Aqueous Finishing of Leather, JALCA, 1991, 442–455.

The preferably used pickled pelts for the iron tanning are preferably subjected to an acidic pretreatment, in particular at a pH of 2–5, particularly preferably at 3–4. In this acidic pretreatment, a delimed and bated pelt is preferably used. In particular, compounds such as carboxylic acids, such as formic acid, acetic acid or oxalic acid, or inorganic acids, such as sulphuric acid, or acidic salts of sulphuric acid or mixtures thereof are used for pickling.

It has been found that the addition of di- or polyfunctional carboxylic acids, for example polymeric or nonpolymeric compounds, during the acidic pretreatment has an advantageous effect in particular on the properties of the leather. Particularly preferred nonpolymeric acids are difunctional carboxylic acids, such as tartaric acid, maleic acid, glutaric acid, phthalic acid and/or adipic acid; trifunctional carboxylic acids, such as citric acid. Preferred polymeric carboxylic acids are copolymers which can be obtained using (meth) acrylic acid, maleic acid or itaconic acid, maleic anhydride or the derivatives thereof with other comonomers which contain no carboxyl groups, by free radical polymerization. Preferred copolymers are those which are prepared by free radical copolymerization of the abovementioned monomers containing carboxyl groups with at least one monomer from the group consisting of the vinyl compounds, such as, for example, styrene, diisobutylene, ethylene, propylene, vinyl ether, vinyl ester, (meth)acrylic ester of alcohols having $C_1$ to $C_{30}$-hydrocarbon atoms, etc. Illustrative examples of the resulting copolymers are polyacrylates. Terpolymers or those copolymers which are composed of more than 3 comonomers are also suitable.

These acids are preferably used in an amount of 0.5 to 10% by weight, based on the pelt used, in particular 1–4% by weight.

The acidic pretreatment preferably takes place in such a way that pickle is added to the pelt used in an amount such that the pH of the resulting bated pelt is reduced to a value of 2–5, in particular to 3–4. The pickling compounds are preferably added in aqueous solution to the pelt in a tanning drum. This is generally effected at a temperature of 0 to 60° C., in particular at 20 to 37° C. Pretreatment is preferably effected for 10 min to 24 h, in particular 30 min. to 2 h.

A fatliquoring agent is particularly preferably also added to the acidic pretreatment. Fatliquoring agents preferred for this use are those which are free of electrolyte-stable anionic emulsifiers, e.g. sulphonated, sulphated or sulphited compounds having an emulsifying effect. For example, fats and oils based on long-chain alkanes, alcohols, esters or other hydrophobic hydrocarbons are suitable here. These compounds may be of natural or synthetic origin, such as, for example, fish oils, neatsfoot oils, vegetable oils or mineral oils.

In a preferred application, emulsifiers based on carboxylic acids, polycarboxylic acids or polyethers may be added to the fatliquoring agents in order to facilitate the processing in aqueous liquor.

The fatliquoring agents used in the pretreatment may advantageously influence the properties of the finished leather, particularly with respect to softness and waterproofness. Based on pelt weight, 0.1–5% by weight, particularly preferably 0.5–3% by weight, are added.

The invention is further described by way of the following illustative but non-limiting examples.

EXAMPLES

Example 1

Preparation of a Silicone-Based Water Repellent with Internal Emulsifier (Corresponds to SIL 4 from EP-A 11 08 765)

1 400 g of trimethylsilyl-terminated polydimethylsiloxane (viscosity 5 000 $mm^2/s$, 25° C.) (commercial product: BAYSILONE® oil M 5000 from Bayer AG) are initially introduced. Thereafter, 49.5 g of 2-aminoethyl-3-aminopropyl-methyl-dimethoxysilane (Dynasilan® 1411, from Hüls) and then 0.86 g of sodium hydroxide solution (50% strength) are added. The content of the vessel is heated to 115° C. in the course of 2 hours. Stirring is effected for 5.25 hours at 115° C., a gentle $N_2$ stream being passed over. Stirring is then effected for a further 0.75 hour in vacuo at 65 hPa. During the condensation (6 hours), 1.5 g of distillate are taken off. After the end of the methanol elimination, the batch is cooled to 25° C. with stirring. A polysiloxane functionalized with 2-aminoethyl-3-aminopropyl side chains is obtained (base N content=0.44% by weight, viscosity at 20° C./100 $s^{-1}$=140 mPa·s).

300 g of the aminopolysiloxane thus prepared and having a base N content of 0.44% by weight are initially introduced at 25° C. and 18.5 g of maleic anhydride are stirred in. The suspension obtained is heated to 65° C. and stirred for 1 hour at 65° C. A clear solution forms thereby. The IR spectrum shows no anhydride band at 1 850 $cm^{-1}$. The viscosity of the intermediate is about 30 000 mPa·s at 100 $s^{-1}$ and 20° C. The batch is then cooled to 50–55° C. 10.6 g of triethylamine are metered in at 55° C. with thorough stirring. The batch is stirred for a further 20 minutes at 55° C., the viscosity gradually increasing (viscosity at 20° C., D=10 $s^{-1}$: about 50 000 mPa·s). Thereafter, 100 g of isopropanol are added and stirring is continued for 30 minutes at 55° C. At 50–55° C., 550 g of water are pumped in within 3 hours with rapid stirring. The dispersion obtained is freed from the solvent at 55° C. and 140–250 hPa. 117.5 g of isopropanol/water mixture are distilled off. A white, finely divided emulsion is obtained. Under these conditions, no froth is observed during the distillation. Cooling to room temperature (≦30° C.) and filtration over a 20 μm sieve are then effected.

| | |
|---|---|
| Solids content: | 36.9% |
| pH: | about 7 (undiluted) |
| Mean particle size: | 174 nm |
| Viscosity: | 36 mPa · s (at 100 $sec^{-1}$, 20° C.). |

Example 2

Preparation of a Silicone-Based Water Repellent with Internal Emulsifier and Little External Emulsifier 654.4 g of trimethylsilyl-terminated polydimethylsiloxane (viscosity 1 000 $mm^2/s$, 25° C.) (commercial product: BAYSILONE® oil M 1000) are initially introduced. Thereafter, 29.3 g of 2-aminoethyl-3-aminopropyl-methyl-dimethoxysilane (Dynasilan® 1411, from Hüls) and then 0.4 g of sodium hydroxide solution (50% strength), if necessary diluted with 5 g of water, are added. The content of the vessel is heated to 115° C. in the course of 2 hours. Stirring is effected for 6 hours at 115° C., a gentle $N_2$ stream being passed over. Stirring is then effected for a further 1 hour in vacuo at 65 hPa. During the condensation (6 hours), 9.5 g of distillate are taken off. A polysiloxane functionalized with 2-aminoethyl-3-aminopropyl side chain is obtained (base N content=0.56% by weight, viscosity at 20° C./100 $s^{-1}$=104 mPa·s).

The aminopolysiloxane thus prepared is initially introduced at 55° C. and 15.6 g of carprolactone and 130 g of ethyl acetate are added. 0.2 g of titanium tetrabutylate or dibutyltin dilaurate and 10 g of ethyl acetate are then added. The mixture is stirred for 10 hours at about 75° C. (the carbonyl band of the lactone (at 1 722 $cm^{-1}$) is no longer present in the IR spectrum). The ethyl acetate is then distilled off (140 g). After cooling to 50° C., 170 g of acetone and 26.9 g of succinic anhydride are added and stirring is effected at 65° C. for 2 hours (anhydride no longer detectable). Thereafter, 29.4 g of triethylamine are metered in with stirring and stirring is continued for a further 10 minutes. 340 g of ethanol are then added. At 55° C., 1 200 g of water are pumped in within 3 hours with rapid stirring. After addition of 0.4 g of Respumit S in 40 g of water, 20 g of a cyanamide-polyurea adduct, referred to below as C-PUR, are added as an emulsifier. The dispersion obtained is freed from the solvent at 50° C. and 140–250 hPa (520 g of distillate) and filtered over a 20 μm sieve. A white finely divided emulsion is obtained.

Aftertreatment is optionally effected in the emulsification process or thereafter by means of a jet disperser (nozzle principle), a flow-through cell with ultrasonic sonotrode or a high shear mixer (rotor-stator principle) or by the use of a high-pressure homogenizer, in order to adjust the particle size of the emulsion.

| | |
|---|---|
| Solids content: | 37% by weight |
| pH: | 7.5 (undiluted) |
| Mean particle size: | 300 nm |
| Viscosity: | 25 mPa · s (at 100 $sec^{-1}$, 20° C.) |
| Shelf-life: | very good |

Description of the Preparation of the Cyanamide-Polyurea Adduct, C-PUR, for Example 2

2 240 g of a difunctional hexanediolpolycarbonatediol (OH number=56) and 82 g of a difunctional propylene oxide polyether (OH number=56) are dehydrated at 120° C./15 hPa. At 80° C., 363 g of 3,5-bis-(6-isocyanatohexyl)-2,4,6-trioxo-tetrahydro-1,3,5-oxadiazine (technical-grade product, MW=422.0), 67.2 g of hexamethylene diisocyanate and 184.3 g of isophorone diisocyanate are added. After 3 hours at 90° C., the prepolymer was diluted with 6 000 g of acetone. 18.0 g of ethylenediamine and 12.5 g of hydrazine hydrate in 300 g of water are added to the solution and stirring is effected for a further 15 minute at 50° C. A solution of 33.6 g of cyanamide and 400 g of water is then added. 20 minutes later, 80.7 g of triethylamine are added. After 45 minutes, the $CO_2$ evolution is complete. The batch is diluted with 6 000 g of water and the acetone is then distilled off under reduced pressure. A finely divided dispersion having a mean particle size of the disperse phase of about 95 nm, a solids content of 32.5% and an efflux viscosity of 12 seconds results.

As shown by the following example, the composition of suitable cyanamide polyadducts is not limited to the above-mentioned composition of C-PUR. A cyanamide polyadduct in which the starting materials and amounts were varied analogously to C-PUR is also suitable:

32.5 g of 3,5-bis-(6-isocyanatohexyl)-2,4,6-trioxo-tetrahydro-1,3,5-oxadiazine (technical-grade product, MW=422.0), 11.3 g of hexamethylene diisocyanate and 29.7 g of isophorone diisocyanate are added at 60° C. to a dehydrated polyol mixture comprising 157.1 g of a difunctional hexanediolpolycarbonatediol (OH number=56), 51.9 g of a difunctional bisphenol A-initiated propylene oxide polyether (OH number=56) and 0.86 g of 2-ethylhexanol.

After 3 hours at 90–95° C., the prepolymer is diluted with 663 g of acetone. After an NCO content of 1.1% has been reached, a solution of 1.43 g of hydrazine hydrate and 5.69 g of isophoronediamine in 42.1 g of water is added at 50–55° C. and the batch is stirred for a further 15 minutes at 50° C. 36.6 g of a 10% strength aqueous solution of cyanamide are then added. 10 minutes later, 8.7 g of triethylamine are added. After 1 hour, the $CO_2$ evolution is complete. The batch is diluted with 632 g of water and the acetone is then distilled off under reduced pressure. A finely divided dispersion having a mean particle size of the disperse phase of about 70 nm, a solids content of 30% and a viscosity of about 10 mPa·s at 20° C./10 $s^{-1}$ results.

Example 3

Preparation of a Silicone-Based Water Repellent (Nonionic) with External Emulsifier 100 g of a linear dimethylpolysiloxane having 2-aminoethylaminopropyl substituents as side groups and a trimethylsilyl terminal group and/or a dimethylsilylmethoxy terminal group, characterized by a base nitrogen content of 0.20% and a viscosity of 650–700 mPa·s at 20° C., are stirred at 20° C. with 15.4 g of an emulsifier, e.g. emulsifier ASN (25% strength in water) from Bayer AG, 12.8 g of cyclohexanol or isobutanol and 0.3 g of acetic acid. 180 g of water are then metered in within 30 minutes.

A transparent emulsion is obtained

Concentration: 35% pH: 6.9

Particle size: <100 nm

Viscosity: <50 mPa·s

Example 4

Solvent-Based Fatliquoring Agent 400 g of a mixture of neatsfoot oil and vegetable oil in the ratio 2:1 are dissolved in 500 g of isopropanol. 30 g of PVA 40/98 and 70 g of an ethoxylated fatty acid are added to the solution.

On stirring into water, a stable emulsion of the fatliquoring agent is obtained.

Example 5

Fatliquoring Agent Based on a Mineral Oil

A mixture of 300 g of mineral oil, viscosity 100 mPa·s, 80 g of a neutralized acrylic acid/stearyl methacrylate copolymer and 620 g of water are mixed by means of a dissolver. A stable emulsion having a particle size of <200 mm is produced by high-pressure dispersing at 700 bar.

Example 6

Fatliquoring Agent Based on a Fish Oil

Purified fish oil and water are processed in the ratio of 1:3 by means of a jet disperser to give an emulsion having a particle size of <100 nm. The emulsion is stabilized by adding 10% of acrylic acid/methacrylic acid/ethylhexyl methacrylate copolymer and 2% of PVA 26/88.

Example 7

Tanning process A, comprising tanning with iron salts using a fatliquoring agent. Starting material: split cattle pelt, 3.0 mm. All amounts stated are based on pelt weight.

| | % | Product | ° C. | Time min. | Remark |
|---|---|---|---|---|---|
| Rinsing | | Water | 35 | | |
| Deliming | 100 | Water | 35 | | |
| | 2.0 | Ammonium sulphate | | | |
| | 0.3 | Sodium bisulphite | | 10 | |
| Bating | 1.1 | Bating enzyme (protease) | | 90 | pH: 9.1 |
| | | | | | Discharge liquor |
| Rinsing | | Water | 20 | | |
| Pre-treatment | 20 | Water | 20 | | |
| Pickling | 6.0 | Sodium chloride | | 5 | °Bé: >6 |
| | 0.3 | Preservative (active substance CMK) | | | |
| | 2.0 | Fatliquoring agent (example 5) | | | |
| | 5.0 | Monosodium phthalate | | 60 | pH: 6.4 |
| | 1.0 | Formic acid 85% 1:10 | | 15 | |
| | 1.5 | Sulphuric acid 1:10 | | 60 | pH: 3.4 |
| Tanning | 13.5 | Basic iron(III) sulphate 45% | | 120 | pH: 1.7; Penetration |
| Basifying | 100 | Water | | | |
| | 2.0 | Sodium formate | | 30 | pH: 2.3 |
| | 0.7 | Magnesium oxide | 40° C. | 60 | pH: 3.0 |
| | 0.7 | Magnesium oxide | 45° C. | 60 | pH: 4.2 |
| Rinsing | | Water | | | |

Analytical data: Fe content 3.7%

Example 8

Tanning process B,comprising tanning with iron salts without use of fatliquoring agent; starting material: split cattle pelt, 4.5 mm. All stated amounts are based on pelt weight.

| | % | Product | ° C. | Time min. | Remark |
|---|---|---|---|---|---|
| Rinsing | | Water | 35 | | |
| Deliming | 100 | Water | 35 | | |
| | 2.5 | Ammonium sulphate | | | |
| | 0.3 | Sodium bisulphite | | 10 | |
| Bating | 1.1 | Bating enzyme (protease) | | 90 | pH: 9.1 |
| | | | | | Discharge liquor |
| Rinsing | | Water | 20 | | |
| Pre-treatment | 20 | Water | 20 | | |
| Pickling | 6.0 | Sodium chloride | | 5 | °Bé: >6 |
| | 0.3 | Preservative (active substance CMK) | | | |
| | 3.0 | Methacrylic acid copolymer | | | |
| | 1.0 | Glutaric acid | | 60 | pH: 4.4 |
| | 1.0 | Formic acid 85% 1:10 | | 15 | |
| | 0.5 | Sulphuric acid | | 60 | pH: 3.4 |
| Tanning | 6 | Iron(III) sulphate | | 120 | pH: 1.7; Penetration |

-continued

| | % | Product | ° C. | Time min. | Remark |
|---|---|---|---|---|---|
| Basifying | 100 | Water | | | |
| | 1.1 | Sodium carbonate 1:10 | | 30 | pH: 2.0 |
| | 1.1 | Sodium carbonate 1:10 | | 30 | pH: 2.7 |
| | 1.1 | Sodium carbonate 1:10 | | 30 | pH: 3.3 |
| Rinsing | | Water | | | |

Analytical data: Fe content 3.6%

Example 9

Retanning process A, comprising preparation of a waterproof saddle leather, thickness 3.5–4 mm, starting from example 7; all amounts used are based on shaved weight.

| Process | + | % | Product | ° C. | Time min. | Remark |
|---|---|---|---|---|---|---|
| Washing | | 200 | Water | 35 | 15 | Discharge liquor |
| Neutralization | | 100 | Water | 35 | | |
| | | 2.0 | Sodium formate | | | |
| | | 4.5 | Sodium bicarbonate | | 60 | pH |
| | | 3.0 | Fatliquoring agent, ex. 5 | | over-night | pH 5.0 Discharge liquor |
| Washing | | 100 | Water | 35 | | Discharge liquor |
| Retanning | | 50 | Water | 35 | | |
| | | 0.3 | Ammonium bicarbonate | | 15 | pH 6.0 |
| | | 4.0 | Fatliquoring agent, ex. 5 | | | |
| | | 4.0 | Polymeric retanning agent, polyaspartic acid derivative | | 30 | |
| | | 8.0 | Synthetic tanning agent, phenyl-sulphonic acid condensate | | | |
| | | 4.0 | Resin tanning agent | | 60 | |
| | | 3.0 | Unsweetened chestnut | | | |
| | | 2.0 | Black dye | | 90 | |
| | | 50 | Water | 50 | 5 | |
| | | 1.0 | Formic acid 1:10 | | 30 | pH 4.3 Discharge liquor |
| | | 200 | Water | 30 | 5 | Discharge liquor |
| | | 50 | Water | 30 | | |
| | | 1.8 | Ammonium bicarbonate | | 30 | pH 7.0 |
| | | 4.0 | Water repellent, example 2 | | 60 | pH 7.0 |
| | | 1.0 | Formic acid 1:10 | | 15 | |
| | | 1.0 | Formic acid 1:10 | | 15 | |
| | | 1.0 | Formic acid 1:10 | | 15 | |
| | | 1.0 | Formic acid 1:10 | | 60 | pH 3.5 |
| Rinsing | | | Water | 50 | 5 | |
| Rinsing | | | Water | 20 | 5 | |

Vacuum drying (60° C., 3 min.), conditioning (65% relative humidity), staking, subsequent plating gives a very strong, full, deep black leather.

Waterproofness: Water penetration measured according to DIN 53338:>8 h at 9% water absorption.

Analytical data: Fe content 2.1%, Si content 0.7%

Example 10

Retanning process B, comprising production of an upper leather, thickness 1.6–1.8 mm, based on tanning process A; all amounts used are based on shaved weight.

| Process | + | % | Product | ° C. | Time min. | Remark |
|---|---|---|---|---|---|---|
| Washing | | 200 | Water | 35 | 15 | Discharge liquor |
| Neutralization | | 100 | Water | 35 | | |
| | | 3.0 | Neutralization tanning agent, ditolyl ether sulphonic acid condensate | | | |
| | | 1.0 | Sodium formate | | 60 | pH 5.8 |
| | | 4.0 | Polymeric retanning agent, polyaspartic acid derivative | | over-night | pH 5.8 Discharge liquor |
| Washing | | 100 | Water | 35 | | Discharge liquor |
| Retanning | | 50 | Water | 35 | | |
| | | 4.0 | Fatliquoring agent, ex. 6 | | | |
| | | 2.0 | Water repellent, example 1 | | | |
| | | 4.0 | Polymeric retanning agent, polyaspartic acid derivative | | 30 | pH 6.0 |
| | | 4.0 | Synthetic tanning agent, phenolsulphonic acid condensate | | | |
| | | 4.0 | Resin tanning agent | | 60 | |
| | | 2.0 | Brown dye | | 90 | |
| | | 50 | Water | 50 | 5 | |
| | | 1.0 | Formic acid 1:10 | | 30 | pH 4.1 Discharge liquor |
| | | 200 | Water | 30 | 5 | Discharge liquor? |
| | | 50 | Water | 30 | | |
| | | 1.8 | Ammonium bicarbonate | | 60 | pH 7.2 |
| | | 3.0 | Water repellent, example 1 | | 60 | pH 7.1 |
| | | 1.0 | Formic acid 1:10 | | 15 | |
| | | 1.0 | Formic acid 1:10 | | 15 | |
| | | 1.0 | Formic acid 1:10 | | 15 | |
| | | 1.0 | Formic acid 1:10 | | 60 | pH 3.6 |
| Rinsing | | | Water | 50 | 5 | |
| Rinsing | | | Water | 20 | 5 | |

Vacuum drying (60° C., 2 min.), conditioning (65% relative humidity), staking gives a soft, full leather with a level dyeing.

Waterproofness: Water penetration measured according to DIN 53338:>8 h at 12% water absorption.

Analytical data: Fe content 3.3%, Si content 1.2%

The full-grained leather was buffed in two passes (paper grain size 120) to give nubuck:

Waterproofness: Water penetration measured according to DIN 53338:>8 h at 14% water absorption.

Water vapour permeability: 11 mg/cm$^2$ h

Analytical data: Fe content 3.3%, Si content 1.1%

Example 11

Retanning process B, comprising production of a split upper leather, thickness 3.3–1.5 mm, based on tanning analogous to tanning process A; all amounts used are based on shaved weight.

| Process | + | % | Product | ° C. | Time min. | Remark |
|---|---|---|---|---|---|---|
| Washing | | 200 | Water | 35 | 15 | Discharge liquor |
| Neutralization | | 50 | Water | 40 | | |
| | | 4.0 | Synthetic tanning agent, phenolsulphonic acid condensate | | 30 | |
| | | 4.0 | Polymeric retanning agent, methacrylic acid copolymer | | 30 | |
| | | 1.0 | Sodium formate | | | |
| | | 3.0 | Sodium bicarbonate | | 60 | pH 5.6 |
| | | 3.0 | Fatliquoring agent, ex. 5 | | 60 | pH 5.6 Discharge liquor |
| Washing | | 200 | Water | 40 | 5 | Discharge liquor |
| Retanning | | 100 | Water | 40 | | |
| | | 3.0 | Fatliquoring agent, ex. 5 | | 40 | |
| | | 6.0 | Synthetic tanning agent, diphenyl sulphone condensate | | 20 | |
| | | 4.0 | Polymeric retanning agent, polyaspartic acid derivative | | 40 | pH 6.0 |
| | | 1.0 | White pigment | | | |
| | | 200 | Water | 30 | 5 | Discharge liquor? |
| | | 50 | Water | 30 | | |
| | | 1.8 | Sodium carbonate | | 45 | pH 6.9 |
| | | 2.0 | Fatliquoring agent, ex. 5 | | 20 | |
| | | 4.0 | Water repellent, example 2 | | 45 | pH 7.0 |
| | | 4.0 | Synthetic tanning agent, diphenyl sulphone condensate with ligninsulphonate | | 30 | |
| | | 1.2 | Formic acid 1:10 | | 30 | |
| | | 1.2 | Formic acid 1:10 | | 15 | |
| | | 1.2 | Formic acid 1:10 | | 30 | pH 3.4 |
| Rinsing | | | Water | 50 | 5 | |
| Rinsing | | | Water | 20 | 5 | |

Drying on toggle frame, conditioning (65% relative humidity), staking, milling gives a soft, round, light beige leather Waterproofness:

Water penetration measured according to DIN 53338:>8 h at 17% water absorption.

Water penetration measured according to ASTM D2099-98: >50 000 flexes at 12% water absorption Water vapour permeability: 18 mg/cm$^2$ h Analytical data: Fe content 3.1%, Si content: 1.0%

Example 12

Retanning process B, comprising production of a sheepskin for garments, 0.8 mm, based on tanning analogous to tanning process A; all amounts used are based on shaved weight.

| Process | + | % | Product | ° C. | Time min. | Remark |
|---|---|---|---|---|---|---|
| Washing (2×) | | 300 | Water | 40 | | pH 3.4 Discharge liquor |
| Neutralization | | 150 | Water | 40 | | |
| | | 2.0 | Neutralization tanning agent, ditolyl ether sulphonic acid condensate | | | |
| | | 1.5 | Sodium bicarbonate | | 30 | pH 6.0 |
| | | 3.0 | Polymeric retanning agent, polyaspartic acid derivative | | 30 | |
| | | 5.0 | Fatliquoring agent, ex. 6 | | 90 over-night | pH 5.5 Discharge liquor |
| Washing (2×) | | 200 | Water | 40 | 5 | Discharge liquor |
| Retanning | | 150 | Water | 40 | | |
| | | 2.0 | Synthetic tanning agent, phenolsulphonic acid condensate | | 10 | |
| | | 1.0 | Red dye | | 20 | |
| | | 5.0 | Polymeric retanning agent, polyaspartic acid derivative | | 30 | |
| | | 5.0 | Water repellent, example 3 | | 60 | |
| | | 3.0 | Resin tanning agent | | | |

Drying by hanging out, conditioning (65% relative humidity), staking, milling gives a soft, round, red leather.

Waterproofness:

Water penetration measured according to DIN 53338: 185 min at 14% water absorption.

Water vapour permeability: 18 mg/cm$^2$ h

Analytical data: Fe content 3.1%, Si content 1.0%

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A process for the production of chromium-free leather comprising treating an iron-tanned leather with a silicone water repellent, wherein the produced chromium-free leather has a waterproofness, measured as penetration time according to DIN 53338, of at least 30 min and has an Fe content of 1 to 6% by weight, based on dry weight, determined after ashing.

2. The process of claim 1, wherein the process further comprises retanning the leather before treating the leather with the silicone water repellent.

3. The process according to claim 2, wherein the leather is subjected to an acidic pretreatment before the leather is treated with the silicone water repellent.

* * * * *